US008554454B2

(12) United States Patent
Hemmerlein et al.

(10) Patent No.: US 8,554,454 B2
(45) Date of Patent: Oct. 8, 2013

(54) SERVICE BAY HIGH PRESSURE COMMON RAIL INJECTOR PERFORMANCE TEST

(75) Inventors: Rodney J. Hemmerlein, Columbus, IN (US); Michael R. Tidwell, Bloomington, IN (US); Anand Manthena, Columbus, IN (US)

(73) Assignee: Cummins Inc., Columbus, IN (US)

( * ) Notice: Subject to any disclaimer, the term of this patent is extended or adjusted under 35 U.S.C. 154(b) by 249 days.

(21) Appl. No.: 13/112,921

(22) Filed: May 20, 2011

(65) Prior Publication Data

US 2011/0313639 A1 Dec. 22, 2011

Related U.S. Application Data

(60) Provisional application No. 61/346,645, filed on May 20, 2010.

(51) Int. Cl.
*F02M 51/00* (2006.01)
*F02M 51/06* (2006.01)

(52) U.S. Cl.
USPC ..... 701/114; 123/479

(58) Field of Classification Search
USPC ..... 701/103, 104, 114; 123/456, 447, 123/472, 478, 479; 73/114.51, 114.43, 114.48, 73/114.52, 114.53, 114.54, 861
See application file for complete search history.

(56) References Cited

U.S. PATENT DOCUMENTS 5,445,019 A * 8/1995 Glidewell et al. ..... 73/114.51
5,633,458 A * 5/1997 Pauli et al. ..... 73/114.51
5,708,202 A * 1/1998 Augustin et al. ..... 73/114.43
6,705,290 B2 * 3/2004 Puckett ..... 123/446
6,732,577 B2 5/2004 Leman et al.
6,748,928 B2 6/2004 Shingole
6,823,834 B2 * 11/2004 Benson et al. ..... 123/299
6,990,855 B2 1/2006 Tuken et al.
7,137,294 B2 11/2006 Eser et al.
7,197,918 B2 4/2007 Shen
7,278,405 B2 10/2007 Takahashi (Continued)

FOREIGN PATENT DOCUMENTS

WO WO 2008/147319 A1 12/2008
WO WO 2009/073108 A1 6/2009

OTHER PUBLICATIONS

International Search Report and Written Opinion, PCT/US2011/037442, Cummins Inc., ISR/US Sep. 6, 2011.

(Continued)

*Primary Examiner* — Mahmoud Gimie
(74) *Attorney, Agent, or Firm* — Krieg DeVault LLP

(57) ABSTRACT

A method for testing a fuel injector including providing an engine with a common rail fuel injection system having one or more fuel injectors; operating the engine at a selected set of operating conditions; conducting a motoring event; allowing a first settling duration; measuring a first rail pressure; operating a first selected injector including operating the first selected injector singly in response to a selected fuel quantity, a selected number of combustion cycles, and a selected number of injections per combustion cycle; allowing a second settling duration; measuring a second rail pressure; calculating a pressure difference value in response to the first rail pressure and the second rail pressure; inferring an amount of fuel delivered by the first selected injector in response to the pressure difference value; and evaluating a first performance factor of the first selected injector in response to the amount of fuel delivered.

28 Claims, 3 Drawing Sheets

(56) References Cited

U.S. PATENT DOCUMENTS

| | | | | |
|---|---|---|---|---|
| 7,543,485 | B2 | 6/2009 | Chemello | |
| 2004/0128054 | A1* | 7/2004 | Jaliwala et al. | 701/104 |
| 2009/0114035 | A1 | 5/2009 | Lehnert | |
| 2009/0139488 | A1 | 6/2009 | Harris et al. | |
| 2010/0147058 | A1* | 6/2010 | Cinpinski et al. | 73/114.51 |

OTHER PUBLICATIONS

International Preliminary Report on Patentability and Written Opinion, International Application No. PCT/US2011/037442, Nov. 29, 2012, 5 pages.

* cited by examiner

SERVICE BAY HIGH PRESSURE COMMON RAIL INJECTOR PERFORMANCE TEST

CROSS-REFERENCE TO RELATED APPLICATIONS

This present application claims the benefit of, U.S. Provisional Patent Application No. 61/346,645 titled "SERVICE BAY HIGH PRESSURE COMMON RAIL INJECTOR PERFORMANCE TEST" filed May 20, 2010, which is incorporated herein by reference in its entirety and for all purposes.

BACKGROUND

The present application relates to fuel injector performance testing, and more particularly, but not exclusively to high pressure common rail fuel injector performance testing.

Present approaches to fuel injector performance testing suffer from a variety of drawbacks, limitations, disadvantages and problems including those respecting system interactions, limited test quantities, imprecise operating conditions, and others. There is a need for the unique and inventive fuel injector performance testing apparatuses, systems and methods disclosed herein.

SUMMARY

One embodiment of the present invention is a unique fuel injector performance test. Other embodiments include apparatuses, systems, devices, hardware, methods, and combinations for fuel injector performance testing. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
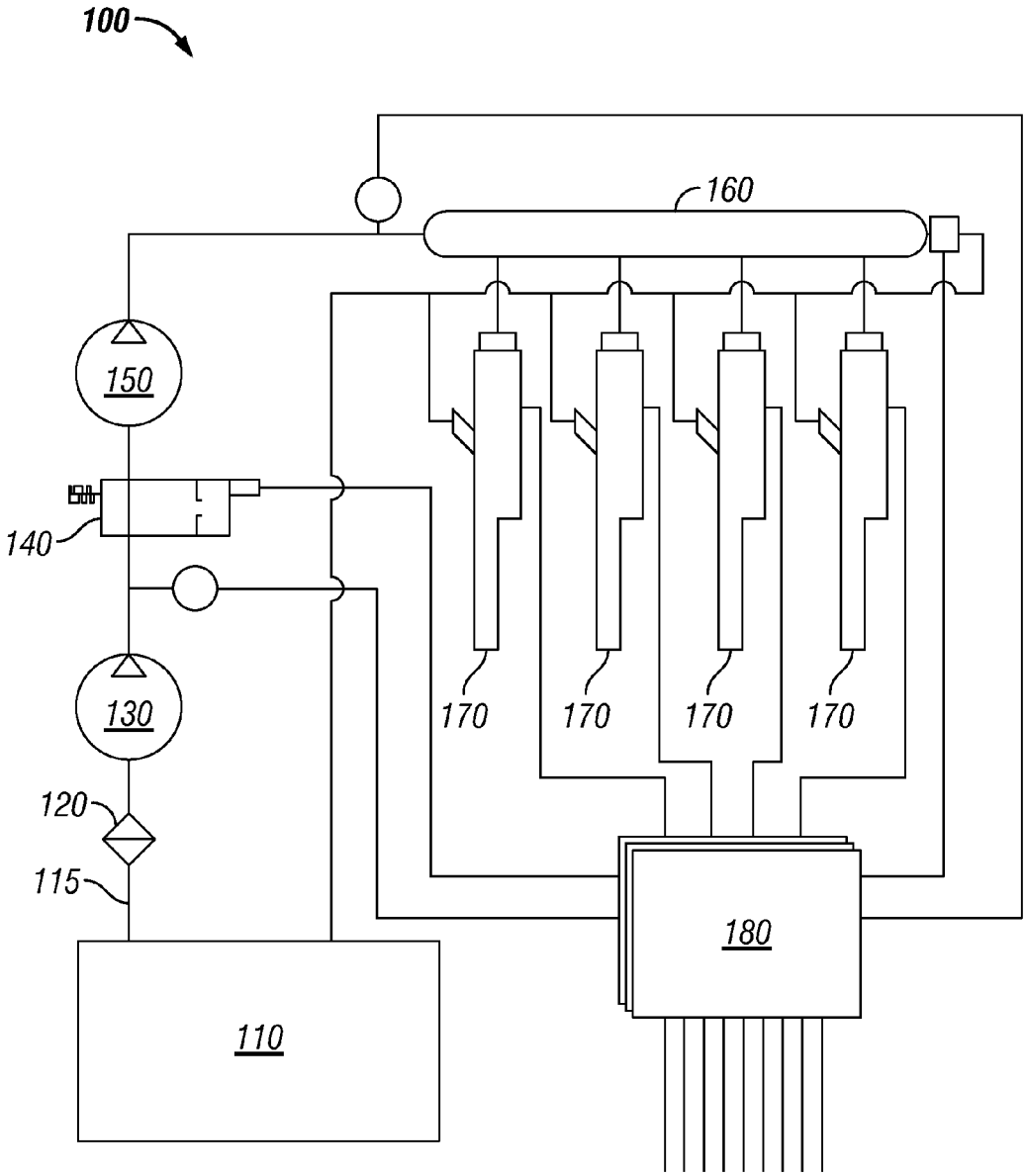
FIG. 1 is a schematic diagram of a common rail fuel injection system.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

One embodiment of the present application includes a method for performance testing a high pressure common rail fuel injection system to identify a non-conforming injector. In a further embodiment, the method includes testing an individual injector of a common rail system at a specified accumulator pressure, specified engine operating conditions, and specified fueling parameters for an engine in a service environment. The method may be conducted on individual injectors at various accumulator pressures, with various fueling quantities and on a variety of engines. A change in the pressure of the high pressure accumulator due to the injections during testing may be interpreted to provide a measurement of fuel delivered by the injector under test. The measurement of fuel delivered may provide information regarding the performance of the injector.

Common rail fuel injection systems feature a high-pressure fuel rail which supplies fuel to a set of individual fuel injectors. The high pressure fuel pump in a common rail system provides fuel to a pressure accumulator reservoir which stores fuel at a high pressure—up to 2,000 bars (29,000 psi) or more. The accumulator is capable of supplying high pressure fuel to multiple fuel injectors. A fuel injector typically includes a nozzle and a valve where the power to inject fuel comes from the pressure of the accumulator reservoir.

Fuel injector performance relates to accurate fuel metering and atomization. An individual fuel injector is typically managed by an engine control unit (ECU) to allow for precise control of the timing and amount of fuel for each injection event. Some fuel injection systems may perform as many as five or more injection events for a single injector per stroke. Variations in the operation of individual fuel injectors may contribute to poor engine performance, increased emissions, increased noise and vibration, and decreased driver satisfaction.

Variations in the operation of a fuel injector may be caused by wear due to contamination in the fuel system or corrosion due to moisture in the fuel. Injector performance may be affected by contaminant particles as small at 10 microns. Replacement of an injector may be a solution for worn fuel injectors to restore original spray patterns, improve fuel mixture formations, and reduce non-uniform spray dynamics. Variations may also be caused by contaminants clogging the fuel passageway which may reduce the amount of fuel being delivered, distort a spray pattern or reduce the ability of the injector to maintain proper air/fuel ratios. Clearing the injector of clogging contaminants may restore the performance of the injector. Reducing variation in fuel injection allows accurate electronic fuel control systems to provide improved engine performance and emission control.

FIG. 1 depicts an exemplary common rail system 100. A fuel tank 110 supplies fuel via a fuel line 115. The fuel passing through a fuel filter 120 to a fuel pump 130. A pressure regulating valve 140 controls the fuel flow as the fuel enters a high pressure fuel pump 150 to be pumped into a common rail accumulator 160. From accumulator 160, fuel is supplied to multiple injectors 170. Common rail system 100 accumulates high-pressure fuel in common rail accumulator 160 and injects the fuel into an engine cylinder with injection timing controlled by an engine ECU 180, thereby allowing high-pressure injection independent from engine speed. When an injector is not operating properly, a potential exists for reduced engine performance and increased emission.

In an embodiment of the present application, a performance test is performed on an engine under specific engine operating conditions. A common rail fuel injection system is operated using specific initial conditions in the fuel system. As the engine is run, the performance test forces a stagnant pressure source in the accumulator. When the injection performance begins, the fuel is injected from a stagnant source at a specified fuel command. During testing, a single injector is operated with the rest of the fuel system disabled. Any pressure drop in the accumulator may be attributed to the fuel released by the injector under test. The pressure drop may be used to infer performance characteristics of the injector under test.

In one embodiment, the performance test may be operated in a service environment. With set service conditions, the measurement resolution may be improved. The capability to create repeated test conditions with controlled system operation makes an average performance measurement possible.

An exemplary common rail injector diagnostic method of the present application allows testing of individual injectors at varied accumulator pressures and fuel quantities for an engine in a service environment. One embodiment includes a method where a target accumulator pressure, engine speed and engine temperature are reached, followed by a motoring event. The motoring event may be started by closing an inlet metering valve to a high pressure pump and cutting out all injectors. After a settling time has elapsed, a first common rail pressure is measured. The injector under test is then operated singly at a set fuel quantity for a set number of combustion cycles and injections per combustion cycle. After the combustion cycles are complete and a second settling time has elapsed, a second rail pressure measurement is collected. The other injectors are returned to operation and the engine is allowed to return to a governed speed.

In a further embodiment, the pressure drop from the first pressure measurement to the second pressure measurement is used to determine the amount of fuel delivered from the injector under test. In a still further embodiment, subsequent tests for the selected injector may be conducted under the selected set of operating conditions to provide an average measurement. In another embodiment, operating conditions may also be varied to provide a spectrum of performance measurements for the selected injector. Variations in the individual injector fuel quantity may be evaluated to determine changes in the injector parameters. The changes in the injector parameters may suggest possible modifications to the injection control of the ECU or indicate a faulty injector requiring repair or replacement. In yet another embodiment, the testing cycle may be repeated with additional injectors to determine injector performance for a given set of test conditions for all injectors in a common rail fuel injection system.

Figure 2:
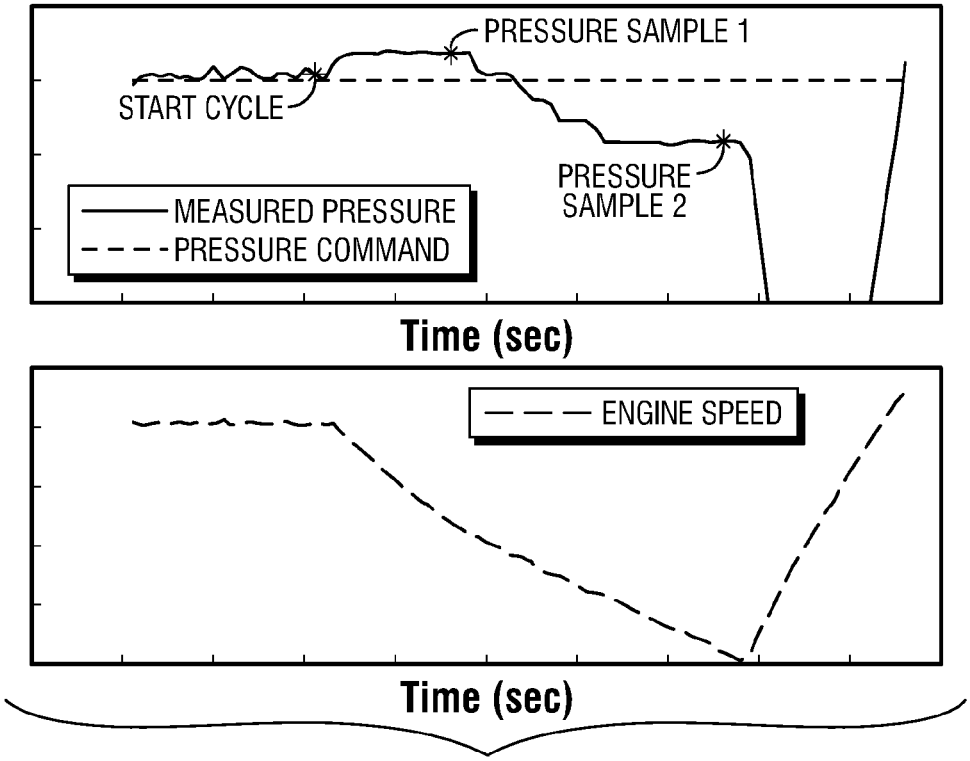
FIG. 2 is a data set of an injector performance test from an embodiment of the present application.

FIG. 2 shows accumulator pressure and engine speed data collected for a test cycle. At the start of the test cycle, the pressure and engine speed were held fairly constant. As the injectors are cut, the engine speed drops and the accumulator pressure builds up. A first pressure measurement is taken. Then the injector under test is operated. The pressure drops until the test sequence is complete and a second pressure measurement is taken. At that point, the other injectors are returned to operation and the engine is allowed to return to a governed speed. Because the other injectors begin operation, the pressure drops sharply until the engine speed returns and the pressure in the accumulator is able to build back up. The pressure change in the high pressure accumulator due to injection during the test cycle may be correlated to an amount of fuel delivered by the injector under test to determine an individual injector fuel quantity for the specified conditions.

Figure 3:
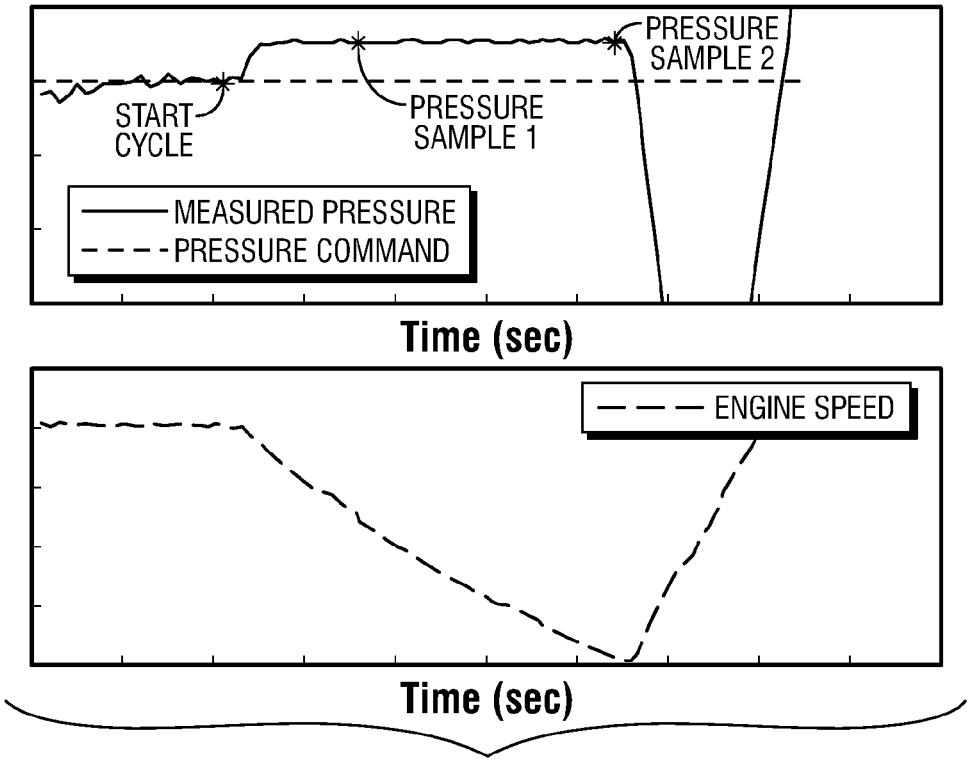
FIG. 3 is a data set of an injector performance test from another embodiment of the present application.

In FIG. 3 a test cycle is shown where no injections are executed. The background test cycle beings with a relative steady-state in accumulator pressure and engine speed. A first pressure measurement is taken followed by a cut in the injector operation for all injectors. During the background test cycle, the engine speed drops as before but the pressure drop is a measurement of how much pressure leaks from the system. At a second point, a second pressure measurement is taken and the engine is allowed to return to normal operation. Because the injectors begin operation, the pressure drops sharply until the engine speed returns and the pressure in the accumulator is able to build back up. This non-injection cycle allows the measurement of a system background leakage value which may be used to compensate the injection pressure drop measurement accordingly or to negate a test due to excessive leakage from or into the accumulator.

An injection performance test of an embodiment of the present application allows testing at low and high fueling quantities for individual injectors under preselected injection conditions. The performance test may be executed on a stationary unloaded engine and may be run without the engine in a normal engine operating mode; rather the test may be used as a troubleshooting aid in an engine service setting. Running the injection performance test in a controlled service bay environment allows more precise control of operating conditions such as engine speed, injection quantity, injection pressure, injection location, number of injection pulses per combustion event, injection pulse separation and engine temperature. By controlling operating conditions during a test, measurement variation and system interactions are more effectively minimized.

In one embodiment, software features for the performance testing of high pressure common rail fuel injection systems may be provided such that the injector performance test is capable of automatic execution on a vehicle when commanded to do so. In another embodiment, the test may be made available to a high pressure equipped engine fitted with the software features. In a further embodiment, a software interface may return information to service personnel regarding the performance of each injector. This information may take the form of service codes that may be used to make an assessment by a service operator regarding the performance characteristics of each injector. The service operator assessment may provide recommendations regarding modification for the injection control by the ECU or indicate a faulty injector requiring repair or replacement.

Figure 4:
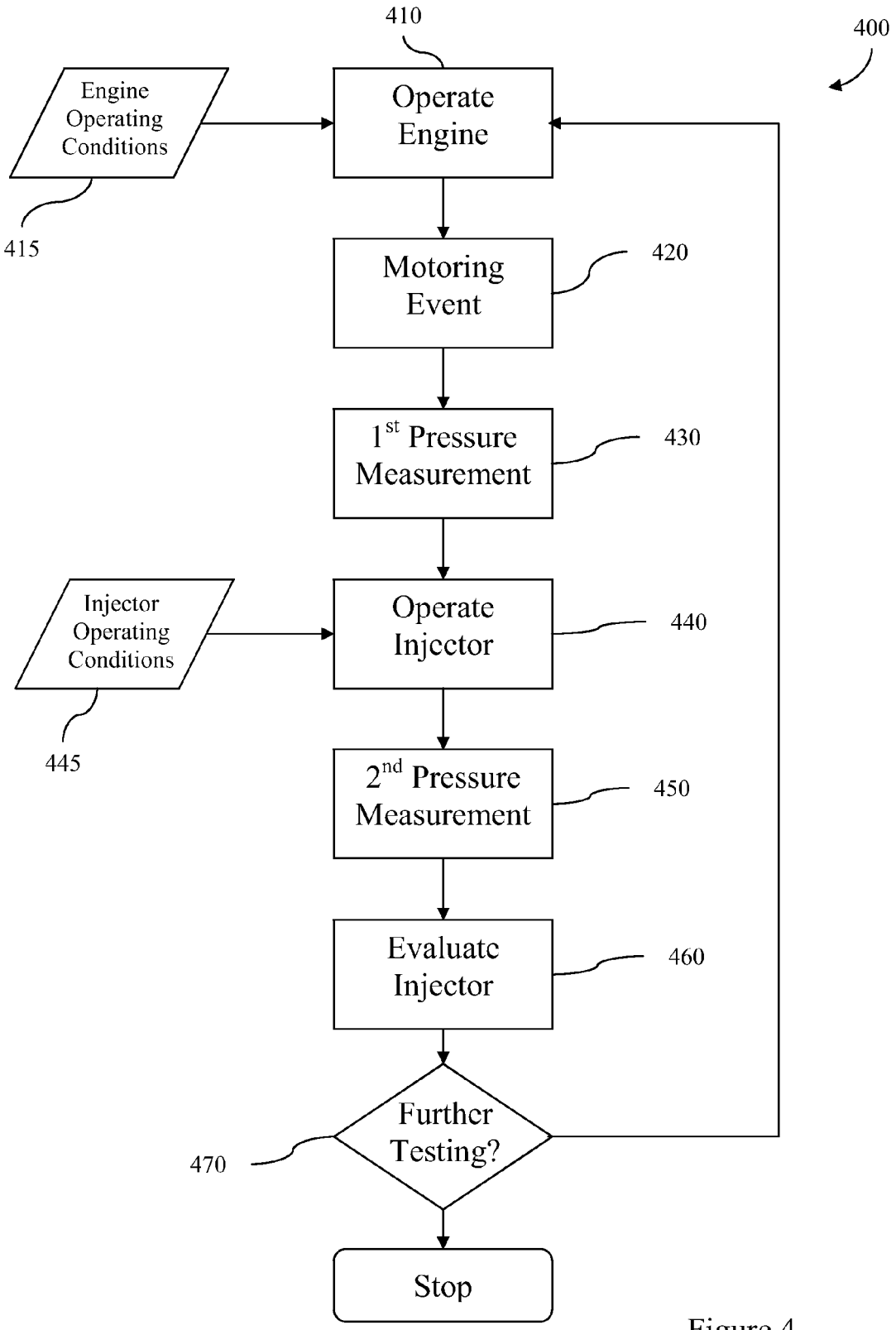
FIG. 4 is a flow diagram representing one embodiment of the present application.

FIG. 4 shows an exemplary injector testing procedure 400 for testing an engine having a high pressure common rail fuel injection system with a plurality of fuel injectors. Procedure 400 may be conducted while the engine is located in a service environment to allow controlled operation of the engine during testing. Procedure 400 has operation 410 which operates the engine. The engine may be operated with selected engine operating conditions 415 such as accumulator pressure, engine speed and engine temperature. When the selected engine conditions are reached, operation 410 may be followed by a motoring event in operation 420. Operation 400 may be initiated by closing the inlet metering valve to the high pressure pump and cutting out all injectors.

Operation 430 is a first rail pressure measurement module. During operation 430, a first rail pressure is measured after a first settling duration. In operation 440, the selected injector under test is then operated. Operation 440 includes operation of a single selected injector which may be operated under selected injector operating conditions 445 such as a specified fuel quantity for a specified number of combustion cycles and a specified number of injections per combustion cycle. After the combustion cycles of operation 440 are complete, operation 450 is a second rail pressure measurement module. Operation 450 includes a second rail pressure measurement after a second settling duration. In operation 460, the performance of the selected injector is evaluated. The pressure difference from the first pressure measurement to the second pressure measurement may be used to infer an amount of fuel delivered from the injector.

Procedure 400 determines whether the testing cycle is complete or whether further testing is necessary in conditional 470. In one embodiment, the testing cycle may be repeated as necessary to determine an average pressure drop for a given set of test conditions for a selected injector. In another embodiment, the testing cycle may be repeated with varied injection operation. In yet another embodiment, the testing cycle may be repeated with a different selected injector. Once procedure 400 determines the performance testing is complete, all injectors are returned to operation and the engine is allowed to return to a governed speed.

In certain exemplary embodiments, a technique similar to that described above in procedure 400 is performed with the exception that no injections are executed during operation 440. This non-operating testing cycle allows the measurement of system background leakage which may be used to compensate the injection pressure drop measurement accordingly or to negate a test due to excessive leakage.

Certain exemplary embodiments include an injection performance test which allows testing at low and high fueling quantities for individual injectors at any desired injection pressure. The test may be executed on a stationary unloaded engine. The test may be run in a service bay whereby system interactions are reduced or minimized relative to service mode operation.

One aspect of the present application is a method for testing a fuel injector including providing an engine with a common rail fuel injection system having one or more fuel injectors which may include providing the engine in a service environment; operating the engine at a selected set of operating conditions; conducting a motoring event; acquiring a first rail pressure measurement; operating a first selected injector; acquiring a second rail pressure measurement; calculating a pressure difference value in response to the first rail pressure measurement and the second rail pressure measurement; inferring an amount of fuel delivered by the first selected injector in response to the pressure difference value; and evaluating a first performance factor of the first selected injector in response to the amount of fuel delivered.

The selected set of operating conditions may include a selected accumulator pressure, a selected engine speed and a selected engine temperature. The motoring event may include closing an inlet metering valve to a high pressure pump and deactivating the one or more fuel injectors. Further features of this aspect may include operating the engine with each of the one or more fuel injectors activated and allowing the engine to return to a governed speed following the testing cycle and determining an average pressure difference value in response to a series of first selected injector tests. Operating the first selected injector may include operating the first selected injector singly in response to a selected fuel quantity, a selected number of combustion cycles, and a selected number of injections per combustion cycle. Acquiring the first rail pressure measurement may further include allowing a first settling duration and measuring a first rail pressure; and acquiring the second rail pressure measurement may further include allowing a second settling duration and measuring a second rail pressure.

A still further feature of this aspect may include operating the engine at a second selected operating condition; conducting a second motoring event; acquiring a third rail pressure measurement; operating the first selected injector; acquiring a fourth rail pressure measurement; calculating a second pressure difference value in response to the third rail pressure measurement and the fourth rail pressure measurement; inferring a second amount of fuel delivered with the first selected injector in response to the second pressure difference value; and evaluating a second performance factor of the first selected injector in response to the second amount of fuel delivered and evaluating a spectrum of performance factors of the first selected injector in response to the first amount of fuel delivered and the second amount of fuel delivered.

Yet another feature of this aspect includes operating the engine at the selected set of operating conditions; conducting the motoring event; acquiring a fifth rail pressure measurement; operating a second selected injector; acquiring a sixth rail pressure measurement; calculating a third pressure difference value in response to the fifth rail pressure measurement and the sixth rail pressure measurement; inferring a third amount of fuel delivered with the second selected injector in response to the third pressure difference value; and evaluating a third performance factor of the second selected injector in response to the third amount of fuel delivered where operating the second selected injector may include operating the second selected injector singly in response to a selected fuel quantity, a selected number of combustion cycles, and a selected number of injections per combustion cycle. Acquiring the fifth rail pressure measurement may further include allowing a fifth settling duration and measuring a fifth rail pressure. Acquiring the sixth rail pressure measurement may further include allowing a sixth settling duration and measuring a sixth rail pressure. The method may include determining a second average pressure difference value in response to a series of second selected injector tests.

Another aspect of the present application is a computer readable medium containing software instructions for performing a high pressure common rail fuel injector performance test including providing an engine with a common rail fuel injection system having one or more fuel injectors; operating the engine at a selected set of operating conditions; conducting a motoring event; acquiring a first rail pressure measurement; operating a first selected injector; acquiring a second rail pressure measurement; calculating a pressure difference value in response to the first rail pressure measurement and the second rail pressure measurement; inferring an amount of fuel delivered with the first selected injector in response to the pressure difference value; and evaluating a first performance factor of the first selected injector in response to the amount of fuel delivered where operating the first selected injector may include operating the first selected injector singly in response to a selected fuel quantity, a selected number of combustion cycles, and a selected number of injections per combustion cycle. A further feature of this aspect may include determining an average pressure difference value in response to a series of first selected injector tests.

It should be appreciated that any of the controls, procedures, tests, calculations, and associated methods of the present application can be executed, in whole or in part, in accordance with programming or other operating logic of an Engine Control Unit (ECU) of the engine/fuel system being monitored and/or one or more other computers, controllers, or processors of an auxiliary device, such as a service tool or other evaluation/monitoring tool. Any such control unit may be structured to execute the same, encoded on one or more forms of computer-readable media, such as a CDROM, DVD, semiconductor device, magnetic disk, or the like.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

operating an engine including a fuel injection system with a fuel supply rail common to at least two fuel injectors;

isolating the fuel supply rail from a fuel supply while operating the engine;

acquiring a first rail pressure measurement;

operating a first one of the injectors;

acquiring a second rail pressure measurement;

determining an amount of fuel provided by the first one of the injectors as a function of the first rail pressure measurement and the second rail pressure measurement;

resuming the supply of fuel to the fuel supply rail while operating the engine;

re-isolating the fuel supply rail from the fuel supply;

determining a background leakage from the fuel supply rail without injecting from the at least two fuel injectors; and evaluating performance of the first one of the injectors based on the amount of fuel and the background leakage.

2. The method of claim 1, wherein the determining of the amount of fueling is performed during servicing of the engine.

3. The method of claim 1, wherein the fuel injection system includes a fuel accumulator, and which includes imposing selected operating conditions during the acquiring of the first rail pressure measurement and the second rail pressure measurement, the operating conditions including a selected accumulator pressure, a selected engine speed, and a selected engine temperature.

4. The method of claim 1, which includes closing an inlet metering valve to a high pressure pump and deactivating the fuel injectors.

5. The method of claim 1, wherein the operating of the first one of the injectors is performed without operating any other of the fuel injectors over a selected number of combustion cycles and a selected number of injections per combustion cycle.

6. The method of claim 1, wherein the acquiring of the first rail pressure measurement further includes:

allowing a first injector settling duration; and measuring the first rail pressure.

7. The method of claim 1, wherein the acquiring of the second rail pressure measurement further includes:

allowing a second injector settling duration; and measuring the second rail pressure.

8. The method of claim 1, which includes operating the engine with each of the injectors activated; and allowing the engine to return to a governed speed.

9. The method of claim 1, further including determining an average pressure difference value in response to a series of injector tests.

10. The method of claim 1, further including acquiring a third rail pressure measurement;

operating the first one of the injectors;

acquiring a fourth rail pressure measurement;

calculating a pressure difference from the third rail pressure measurement and the fourth rail pressure measurement;

determining a second amount of fuel delivered with the first one of the injectors based on the second pressure difference value; and evaluating a performance factor of the first one of the injectors based on the second amount.

11. The method of claim 1, where the determining of the amount of fuel includes determining a difference between the first rail pressure measurement and the second rail pressure measurement.

12. The method of claim 1, further including operating the engine at a predefined set of operating conditions;

conducting a motoring event;

acquiring a third rail pressure measurement;

operating a second one of the injectors;

acquiring a fourth rail pressure measurement;

calculating a difference value from the third rail pressure measurement and the fourth rail pressure measurement; and determining an amount of fuel delivered with the second one of the selected injectors based on the difference value.

13. The method of claim 1, which includes servicing the fuel injection system based on the evaluating of the performance of the first one of the fuel injectors.

14. A method, comprising:

operating an engine including a fuel injection system, the fuel injection system including two or more fuel injectors operatively coupled to a common fuel rail to supply fuel thereto and a fuel accumulator in fluid communication with the rail;

isolating the fuel accumulator and the common fuel rail from a fuel supply while operating the engine;

selecting a first one of the injectors;

determining a first value representative of a first rail pressure;

after the determining of the first value, injecting fuel with the first one of the injectors;

after the injecting of the fuel, determining a second value representative of a second rail pressure;

resuming the supply of fuel to the fuel accumulator and the common fuel rail while operating the engine;

re-isolating the fuel accumulator and the common fuel rail from the fuel supply;

determining a background leakage from the fuel accumulator and the common fuel rail without injecting from the two or more fuel injectors; and establishing an amount of fuel injected by the first one of the injectors based on a difference between the first value and the second value and the background leakage.

15. The method of claim 14, which includes evaluating performance of the first one of the injectors in correspondence to the amount of fuel.

16. The method of claim 15, which includes servicing the first one of the injectors if the performance is unacceptable.

17. The method of claim 14, which includes:

repeating the determining of the first value and the second value and the injecting of the fuel to determine a corresponding number of rail pressure difference values;

evaluating performance of the first one of the injectors as a function of the rail pressure difference values.

18. The method of claim 17, which includes:

calculating one or more statistics from the difference values; and applying the statistics to perform the evaluating of the first one of the injectors.

19. The method of claim 18, wherein the statistics include an average of the difference values.

20. The method of claim 14, which includes:

repeating the determining of the first value and the second value and the injecting of the fuel with each of the injectors to determine a number of corresponding pressure difference values; and evaluating performance of each of the injectors in correspondence to the pressure difference values.

21. The method of claim 14, wherein the fuel injectors other than the first one of the injectors do not inject fuel for the time period spanning the performance of: determining of the first value, the injecting of the fuel with the first one of the injectors, and the determining of the second value.

22. An apparatus, comprising: a control unit structured to be operatively coupled to an engine that includes a fuel injection system with two or more fuel injectors operatively coupled to a common fuel rail to supply fuel thereto, and a sensor to detect rail pressure, the control unit including at least one computer readable medium defining instructions executable by the control unit to: determine a first value representative of a first rail pressure, inject fuel with a first one of the injectors after the first value is determined, determine a second value representative of a second rail pressure, determine a background leakage of the fuel injection system, and evaluate performance of the first one of the injectors from the first value and the second value and the background leakage.

23. The apparatus of claim 22, further comprising means for calculating a third value from the first value and the second value representative of a pressure difference.

24. The apparatus of claim 23, further comprising means for assessing performance of each of the injectors as a function of corresponding rail pressure difference.

25. The apparatus of claim 22, wherein the control unit is included in a service tool.

26. The apparatus of claim 22, wherein the engine is operatively coupled to the control unit and includes a plurality of cylinders.

27. The apparatus of claim 22, further comprising means for evaluating each of the injectors from a corresponding pressure difference;

after the injecting of the fuel, determining a second value representative of a second rail pressure; and establishing an amount of fuel injected by the first one of the injectors based on a difference between the first value and the second value;

evaluating performance of the first one of the injectors in correspondence to the amount of fuel.

28. The apparatus of claim 22, further comprising a fuel accumulator in fluid communication with the rail.

* * * * *